US006530150B1

(12) United States Patent
Barish

(10) Patent No.: US 6,530,150 B1
(45) Date of Patent: Mar. 11, 2003

(54) ATTACHMENTS FOR ELECTRICAL SHAVER AND AUXILIARY CLEANING DEVICE USEFUL FOR ELECTRICAL SHAVER

(76) Inventor: Benjamin J. Barish, 36 Yehuda Hanassi Street, Tel Aviv (IL), 69206

( * ) Notice: Subject to any disclaimer, the term of this patent is extended or adjusted under 35 U.S.C. 154(b) by 0 days.

(21) Appl. No.: 09/718,347

(22) Filed: Nov. 24, 2000

Related U.S. Application Data

(63) Continuation-in-part of application No. 09/312,765, filed on May 17, 1999, now Pat. No. 6,226,870.

(60) Provisional application No. 60/168,763, filed on Dec. 6, 1999, provisional application No. 60/174,384, filed on Jan. 4, 2000, and provisional application No. 60/194,034, filed on Apr. 3, 2000.

(51) Int. Cl.[7] ..... B26B 19/42; B26B 19/14

(52) U.S. Cl. ..... 30/34.2

(58) Field of Search ..... 30/34.2, 41

(56) References Cited

U.S. PATENT DOCUMENTS 4,250,617 A * 2/1981 Bakker et al. ..... 30/34.2
4,899,442 A * 2/1990 Horii et al. ..... 30/34.2
5,092,042 A * 3/1992 Miller et al. ..... 30/34.2 X
6,131,288 A * 10/2000 Westerhof et al. ..... 30/41

* cited by examiner

*Primary Examiner*—Douglas D. Watts

(57) ABSTRACT

An attachment particularly useful for adapting an electrical shaver for wet shaving, includes a cap having a sharp scraping edge located to engage a user's skin forwardly of the cutter head, when the cap is attached to the shaver, to erect hairs and to taughten the skin before engaged by the cutter head. The attachment may also include a dispenser for dispensing a shaving lotion during shaving. Also described are an auxiliary cleaning device which may be used for cleaning or drying a shaver head, and a kit including some or all of the foregoing.

7 Claims, 9 Drawing Sheets

ATTACHMENTS FOR ELECTRICAL SHAVER AND AUXILIARY CLEANING DEVICE USEFUL FOR ELECTRICAL SHAVER

RELATED APPLICATIONS

This application is a Continuation-in-Part of U.S. application Ser. No. 09/312,765 filed May 17, 1999, which application issued as U.S. Pat. No. 6,226,870, on May 8, 2001. The present application is also related to Provisional Applications No. 60/168,763 filed Dec. 6, 1999, No. 60/174,384 filed Jan. 4, 2000, and No. 60/194,034 filed Apr. 3, 2000, and claims their respective priority dates.

FIELD AND BACKGROUND OF THE INVENTION

The present invention relates to attachments for electrical shavers, and also to a cleaning device useful for cleaning shavers. The attachments and cleaning device are particularly useful when an electrical shaver is to be used for wet shaving with soap and water, cream, lotion, or other substance lubricating the skin; and the invention is therefore described below with respect to such an application.

Electrical shavers were originally designed and used for dry shaving, to provide the convenience of shaving whenever and wherever desired, and also to reduce the danger of nicks or cuts present in wet shaving with a blade. However, in recent years, a number of electrical shavers have appeared on the market which may also be used for wet shaving with soap and water or with a shaving lotion, to thereby provide the advantages of a close and smooth shave, convenient cleaning, and a refreshing after-feeling previously obtainable only with a wet shave using a blade.

My U.S. patent application Ser. No. 09/312,765, filed May 17, 1999, discloses an electrical shaver which is particularly useful for wet shaving as well as for dry shaving. Several preferred embodiments of the invention are described in that patent application, in which the electrical shaver is of the rotary-type, including a plurality of shear members formed with a plurality of hair-entry slits, and rotary cutter members each rotated within one of the shear members for cutting hairs entering through the slits.

Some of the preferred embodiments described in that patent application include a scraper member particularly useful when the electrical shaver is used for wet shaving. Thus, when the electrical shaver is so used, a lubricating substance (soap and water, shaving lotion, cream, etc.) lubricates the skin so that the shaver head smoothly glides over the skin. However, such a substance also wets and lubricates the hairs growing on the skin, so that the shaver may also glide over hairs and fail to closely cut some hairs during a pass. The main purpose of the scraper member described in that patent application is to engage and erect the hairs in advance of the shear members, thereby better assuring a cleaner and closer cutting of the hairs in a minimum number of passes. The scraper member also tends to taughten the skin before engaged by the shear member, thereby enhancing the closeness of the shave in a manner similar to the action of the 2-blade or 3-blade safety razor. The described embodiments include one having a separate scraper member built into the shaver head for each shear member, and another having a common scraper member built into the shaver head enclosing all the shear members.

OBJECTS AND BRIEF SUMMARY OF THE INVENTION

One object of the present invention is to provide an attachment for an electrical shaver which attachment includes a scraper member in the form of a cap easily attachable to the electrical shaver, e.g., for wet shaving, or detachable from it, e.g., for dry shaving. Another object is to provide an attachment which includes, in addition to the scraper cap, or instead of a scraper cap, a dispenser for dispensing shaving lotion during shaving, thereby enabling existing electrical shavers also to be used for wet shaving with a shaving lotion. A further object is to provide an air impelling device that may be used for conveniently air-drying a cutter head when used for wet shaving, or air-cleaning a cutter head when used for dry shaving; and a still further object is to provide a kit including some or all of the foregoing attachments, as well as a supply of shaving lotion, particularly useful for wet shaving.

According to one aspect of the present invention, there is provided an attachment for an electrical shaver including a housing having an electrical motor, and a cutter head carried at one end of the housing and driven by the electrical motor; the attachment including a cap having a sharp scraping edge located to engage a user's skin forwardly of the cutter head, when the cap is attached to the shaver, to erect hairs and to taughten the skin before engaged by the cutter head.

It will thus be seen that an attachment for an electrical shaver constructed in accordance with the foregoing features provides the above-described advantages of erecting the hair and taughtening the skin when the shaver is used for wet shaving. However, it has additional important advantages. Thus, by providing the scraper member in a separate cap attachable to and detachable from the shaver head, the invention enables existing shaver heads to be used without change. It also enables an electrical shaver to be easily adapted for wet shaving by merely attaching the scraping-member cap, or for dry shaving by merely removing the cap if desired.

This aspect of the invention is to be distinguished from the multi-purpose attachment for ladies shavers described in U.S. Pat. No. 5,621,971, which differs in purpose, structure and mode of operation from the present invention. The device described in U.S. Pat. No. 5,621,971 is intended to provide a guard to permit ladies to shave under arms without pinching and cutting the skin; whereas the device of the present invention is intended to provide a scraper member, particularly but not exclusively for use in wet shaving, to engage and erect the hairs before engaged by the cutter members. Thus, the device of the patent provides a blocking surface which effectively blocks a substantial portion of the slits in the shear member, whereas the device of the present invention provides a scraping edge which scrapes the skin and erects the hair before the arrival thereat of the shear member (or other cutter head). In addition, while the cap in U.S. Pat. No. 5,621,971, includes a separate aperture for receiving each shear member, in the preferred embodiments of the present invention described below, the cap is formed with a single enlarged opening defined by a border carrying the scraping edge, which border is configured to circumscribe all the shear members when the cap is attached.

According to another aspect of the invention, there is provided an attachment for an electrical shaver including a housing having an electrical motor, and a cutter head carried by an end wall of the housing and driven by the electrical motor; the attachment including a dispenser for manually dispensing a quantity of shaving lotion during shaving, and attaching means for releasably attaching the dispenser to the electrical shaver.

This aspect of the invention is to be distinguished from the existing electrical shaver which includes a built-in shaving lotion dispenser. Since the lotion dispenser is provided in an attachment, rather than being built-in to the electrical shaver, this aspect of the invention enables many different models of existing electrical shavers to be adapted for shaving with a lotion by merely attaching the lotion-dispenser attachment thereto.

Moreover, in the existing electrical shaver having a built-in lotion dispenser, the conventional cutter bar provided for trimming sideburns, mustaches, or beards, is removed and provided in a separate attachment since its place is occupied by the built-in dispenser. When the lotion dispenser, however, is provided in an attachment, rather than being built-in, removal of the attachment enables the conventional cutter bar to be used in the conventional electric shaver.

Another advantage in the use of an attachable lotion-dispenser, rather than a built-in lotion dispenser, is that it permits the user to use any desired shaving lotion (e.g., a relatively inexpensive skin moisturizer lotion), and to refill the dispenser from a large container, e.g., via a manual pump commonly provided on such moisturizer containers, thereby minimizing the expense, as well as increasing the lotion choices, to the user.

According to yet another aspect of the present invention, there is provided an auxiliary cleaning device comprising a socket for receiving a detached cutter head; and a chamber which is manually expansible and contractible to impel air through the cutter head when received in the socket for air-cleaning and/or air-drying the cutter head. As will be described more particularly below, the auxiliary cleaning device can be used for drying a cutter head after used for wet shaving, but can also be used for cleaning a cutter head after used for dry shaving.

Many other features and advantages of the devices in the present application will be apparent from the description below.

BRIEF DESCRIPTION OF THE DRAWINGS

The invention is herein described, by way of example only, with reference to the accompanying drawings, wherein.

DESCRIPTION OF PREFERRED EMBODIMENTS

Figure 1:
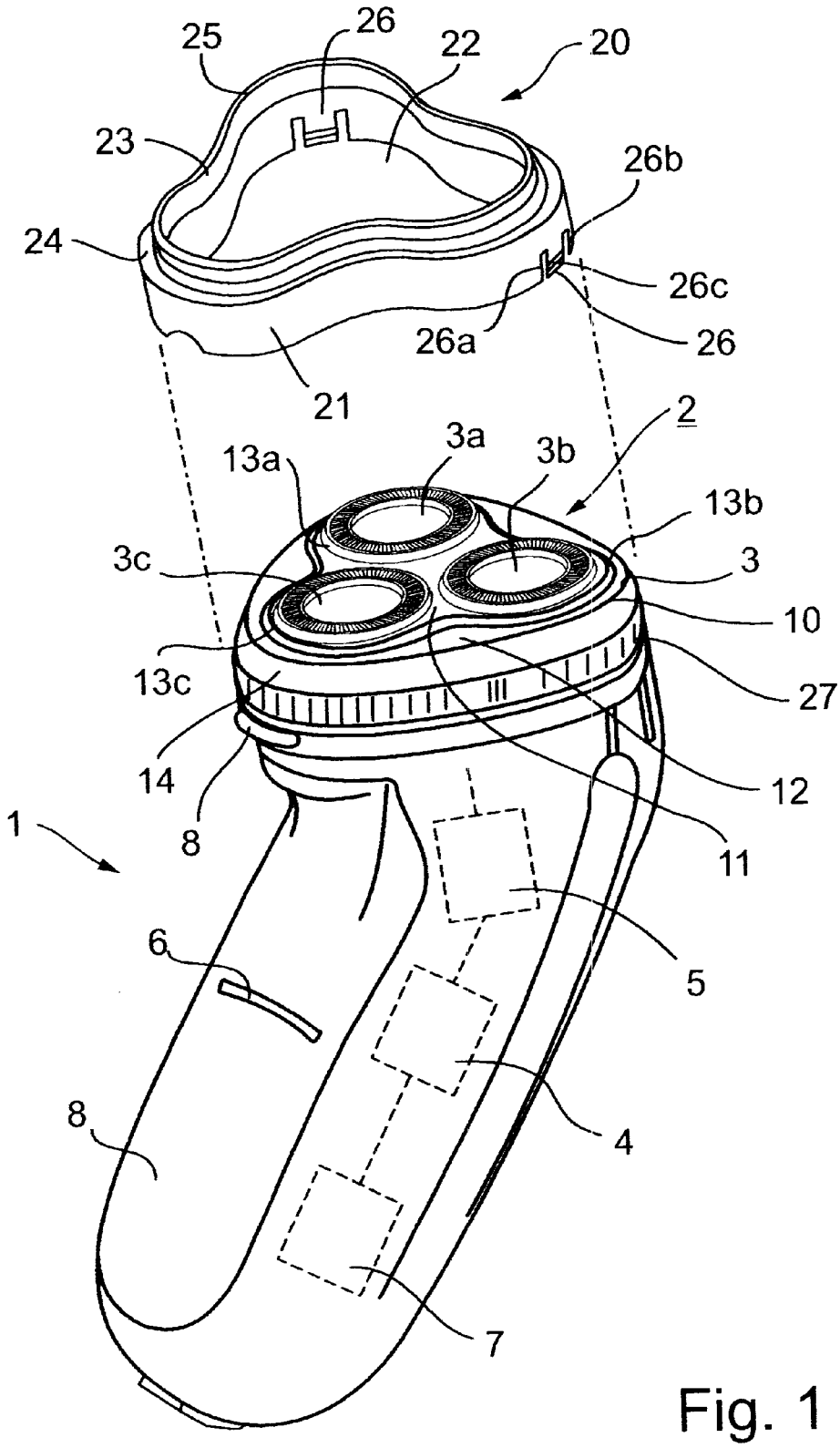
FIG. 1 is an exploded perspective view illustrating one form of electrical shaver scraper cap attachment constructed in accordance with the present invention.

The electrical shaver illustrated in FIGS. 1–4 may be a well-known rotary-type electrical shaver, such as the Remington Sport Wet/Dry Shaver Model R856, or the Philips Philashave shaver. It includes a housing 1 of an elongated configuration to be readily grasped by the user, and a cutter head assembly 2 at one end to be pressed against and moved across the user's face or other surface to be shaved. The cutter head assembly 2 is in the form of a lid pivotally or removably mounted to housing 1. It includes an end wall 3 of a triangular cloverleaf configuration mounting three rotary-type cutter heads 3*a*, 3*b*, 3*c* in a triangular array. The housing 1 includes an electrical motor drive 4 coupled by a transmission 5 having three rotary drive shafts for driving the cutter heads. Motor 4 is controlled by a manual switch 6 and is powered by a rechargeable battery 7. Housing 1 further includes a depressible release button 8 for releasing the cutter head assembly 2 to permit it to be pivoted to an open position, or to be detached from the housing.

As also seen in FIG. 1, end wall 3 of the housing is formed with a peripheral step 10 of a cloverleaf configuration corresponding to the configuration of the end wall. Step 10 defines a central planar section 11 on the inner side of the step, and a peripheral recess section 12 on the outer side of the step. The central planar section 11 is formed with three openings 13*a*, 13*b*, 13*c*, in a triangular array, for receiving the cutter heads 3*a*–3*c*, respectively. The peripheral recess section 12 of end wall 3 merges with a sidewall 14 enclosing the three cutter heads 3*a*–3*c*.

Figure 3:
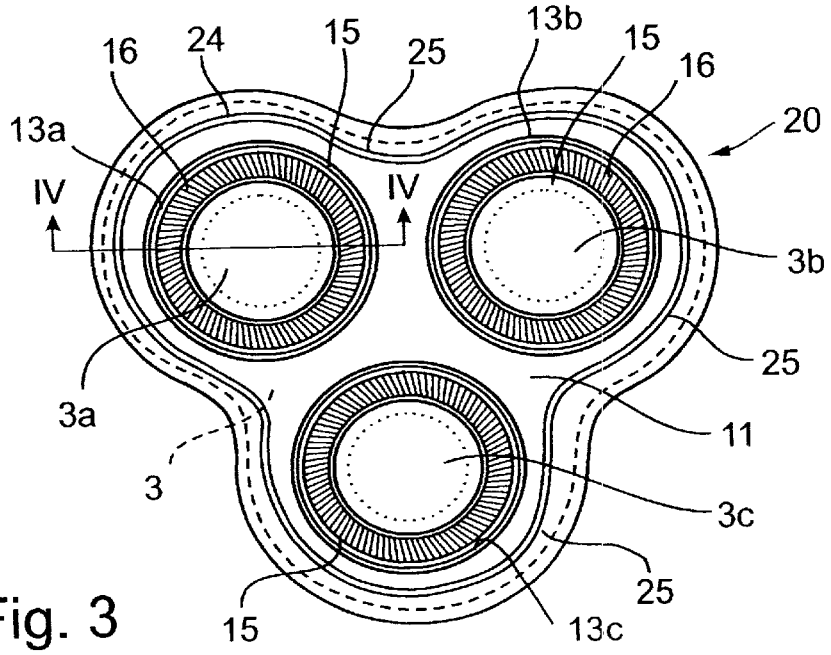
FIG. 3 is a plan view of the cap and electrical shaver.
Figure 4:
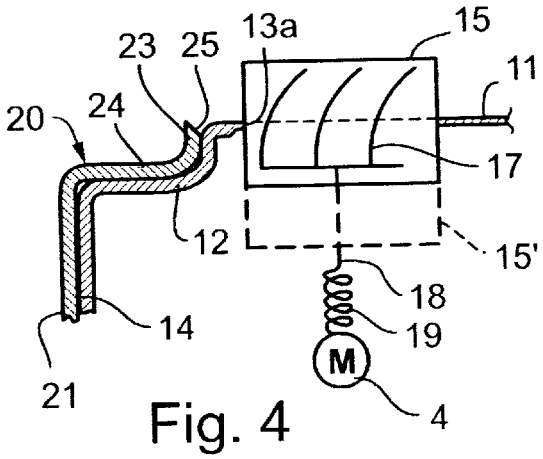
FIG. 4 is a fragmentary sectional view along line IV—IV of FIG. 3.

Each of the three cutter heads 3*a*–3*c* includes an outer shear member 15 (e.g., FIG. 3) formed with a plurality of hair entry slits 16, and a rotary cutter member, shown schematically at 17 in FIG. 4, rotatably mounted within the shear member 15 for cutting the hairs entering that member via the slits 16. The rotary cutter members 17 are coupled to the electrical motor 4 via a coupling, schematically shown at 18 in FIG. 4, including a spring 19 which is effective to urge the rotary cutter members 17 against their respective shear members 15. The shear members 15 are movable within their respective openings 13*a*–13*c* to a normal extended position, shown in full lines in FIG. 4, to a retracted position, shown in broken lines 15' in FIG. 4, wherein their outer surfaces are substantially flush with the outer surface of the planar central section 11 of the end wall 3 when the shaver head is pressed against the user's skin (e.g., face) being shaved.

The general construction of such a rotary-type electrical shaver is described in many prior patents, e.g., U.S. Pat. No. 5,408,749. It will be appreciated, however, that the invention could be utilized in other rotary-types of electrical shavers, such as those sold by Norelco, Philips, and Remington, as well as in vibrating-types of electrical shavers.

FIG. 1 also illustrates a scraper member, generally designated 20, in the form of a cap removably attachable to the shaver head. Cap 20 includes a sidewall 21 of the same triangular configuration as the shaver head, and an enlarged opening 22 having a border 23 configured to circumscribe all the shear members 15 when the cap is attached to the shaver housing. Thus border 23 of the enlarged opening 22 corresponds to the configuration of, and abuts against, the peripheral step 10 of the shaver end wall 3, with the peripheral section 24 of the cap overlying the peripheral recess section 12 of the shaver end wall.

Border 23 includes a sharp edge 25 which projects outwardly of the peripheral section 24 of the cap. When the cap is applied, sharp edge 25 is spaced radially from each shear member 15 to engage the user's skin forwardly of the respective shear member (FIG. 4) during a shaving operation.

Cap 20 is further provided with retainer elements 26 for releasably retaining the cap on the shaver housing. Each retainer element 26 is formed with two parallel slits 26*a*, 26*b* in two opposite sides of the cap sidewall 21 and a recess 26*c* between them. Retainer elements 26 cooperate with retainer ribs 27 on the shaver head (normally provided to releasably retain a protective cap) also to releasably retain the scraper cap in place.

FIG. 4 illustrates a construction wherein the cap 20 is completely made from a single material, such as metal, plastic, or metal-plated plastic.

Figure 5:
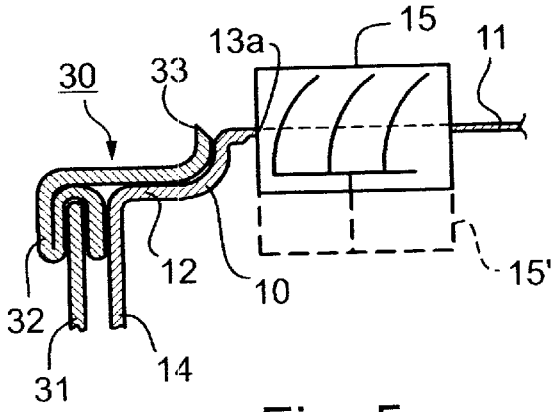
FIG. 5 is a view similar to that of FIG. 4 but illustrating a modification in the construction of the scraper cap attachment.

FIG. 5 illustrates a construction wherein the cap, therein designated 30, includes a plastic side wall 31 and a metal insert 32 applied thereover configured to define the enlarged opening (corresponding to opening 22, FIG. 1) bordered by the outwardly-projecting, sharp scraping edge 33 located so as to be radially spaced from each shear member 15 when the cap is applied.

Figure 2:
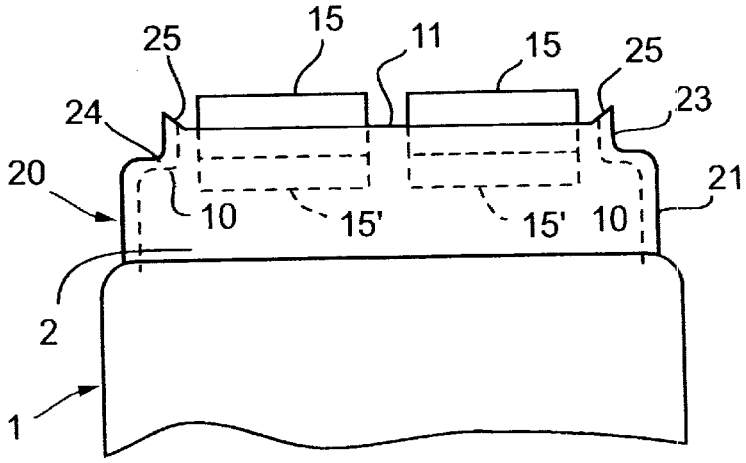
FIG. 2 is a side elevational view of the upper portion of the electrical shaver with the scraper cap attachment applied.

For a wet shave, (i.e., with soap and water, lotion or other substance lubricating the skin), the cap 20 (or 30) is applied as shown in FIG. 2 over end wall 3 of the shaver housing 2 to provide the outwardly-projecting scraping edge 25 radially spaced from each shear member 15. When the shaver head is pressed against the user's skin, the shear members 15 (and also the rotary cutter members 17 within them) are moved to their retracted positions, as shown in broken lines 15' in FIGS. 4 and 5, substantially flush with the central planar section 11 of the shaver end wall 3. The scraper edge 25, therefore, projects outwardly of the outer surface of the shear members 15 and is pressed into the user's skin forwardly of the shear members, to thereby engage and erect the hairs before they reach the hair entry slits of the shear members 15. In addition, the scraping edge 27 tends to taughten the skin, similar to the action produced by the 2-blade or 3 blade safety razor, to produce a clean, close shave.

When the shaver is to be used for a dry shave, the cap 20 (FIGS. 1–4) or 30 (FIG. 5) may be detached from the shaver head 3, if desired, and the shaver then used in the conventional manner without the cap.

In the above-described embodiments, the scraping edge (25, FIGS. 1–4 and 33, FIG. 5) circumscribes all the shear members 15 of the three cutter heads 3*a*, 3*b*, 3*c*, as shown particularly in FIG. 3. Accordingly, the scraper edge 25 will engage the user's skin forwardly of the shear members irrespective of the direction of movement of the shaver head across the user's face.

Figure 6:
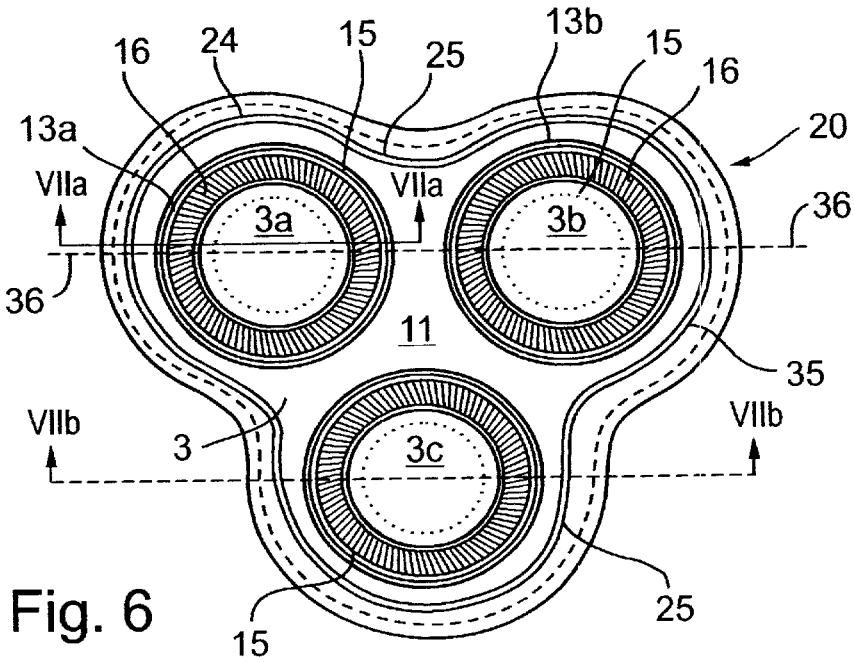
FIG. 6 is a view similar that of FIG. 3 but showing a scraping edge cooperable with only a portion of two of the shear members (the upper portions of the upper two), the lower shear member being devoid of a scraping edge.
Figure 7A:
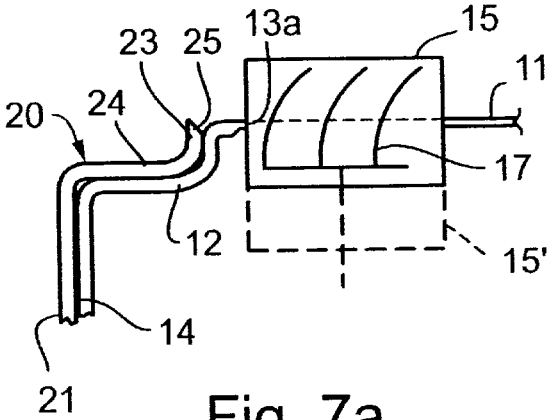
FIG. 7*a* is a sectional view along line VIIa—VIIa of FIG. 6.
Figure 7B:
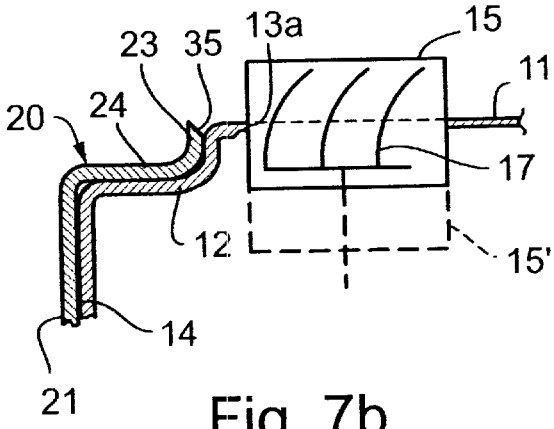
FIG. 7*b* is a sectional view along line VIIIb—VIIIb of FIG. 6.

FIGS. 6, 7*a*, 7*b* illustrate a modification wherein the scraping edge does not enclose all the shear members, but rather extends for only a portion of two of the shear members. As shown in FIG. 7*a*, the scraper edge 25 extends only for the upper one-half circumference of the two upper shear members 15, terminating at the line 36 through the centers of those two shear members; below line 36, this edge is flat or rounded, as shown at 35 in FIG. 7*b*. Accordingly, the scraper member will be effective to produce the above-described hair-erecting and skin-taughtening actions only when the shaver head is moved upwardly. Such a construction, however, substantially decreases the surface area of the scraper edge in contact with the skin, and therefore may be desirable particularly for dry shaving to produce a smoother gliding movement of the shaver head over the skin.

Figure 8:
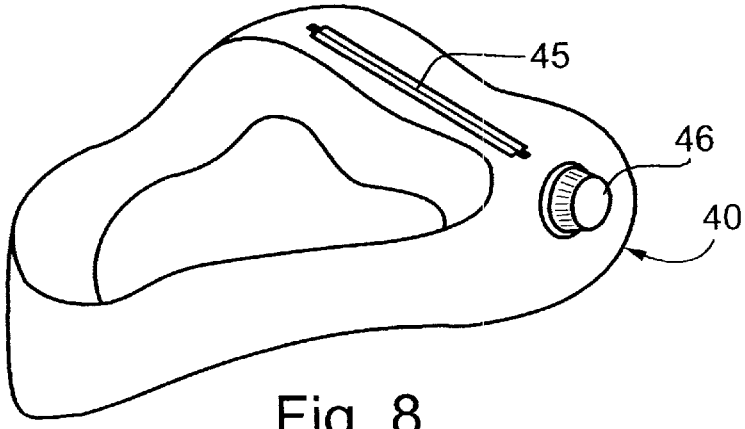
FIG. 8 is a perspective view illustrating a scraper cap having a scraping edge which is usually extendible and retractable.
Figure 9:
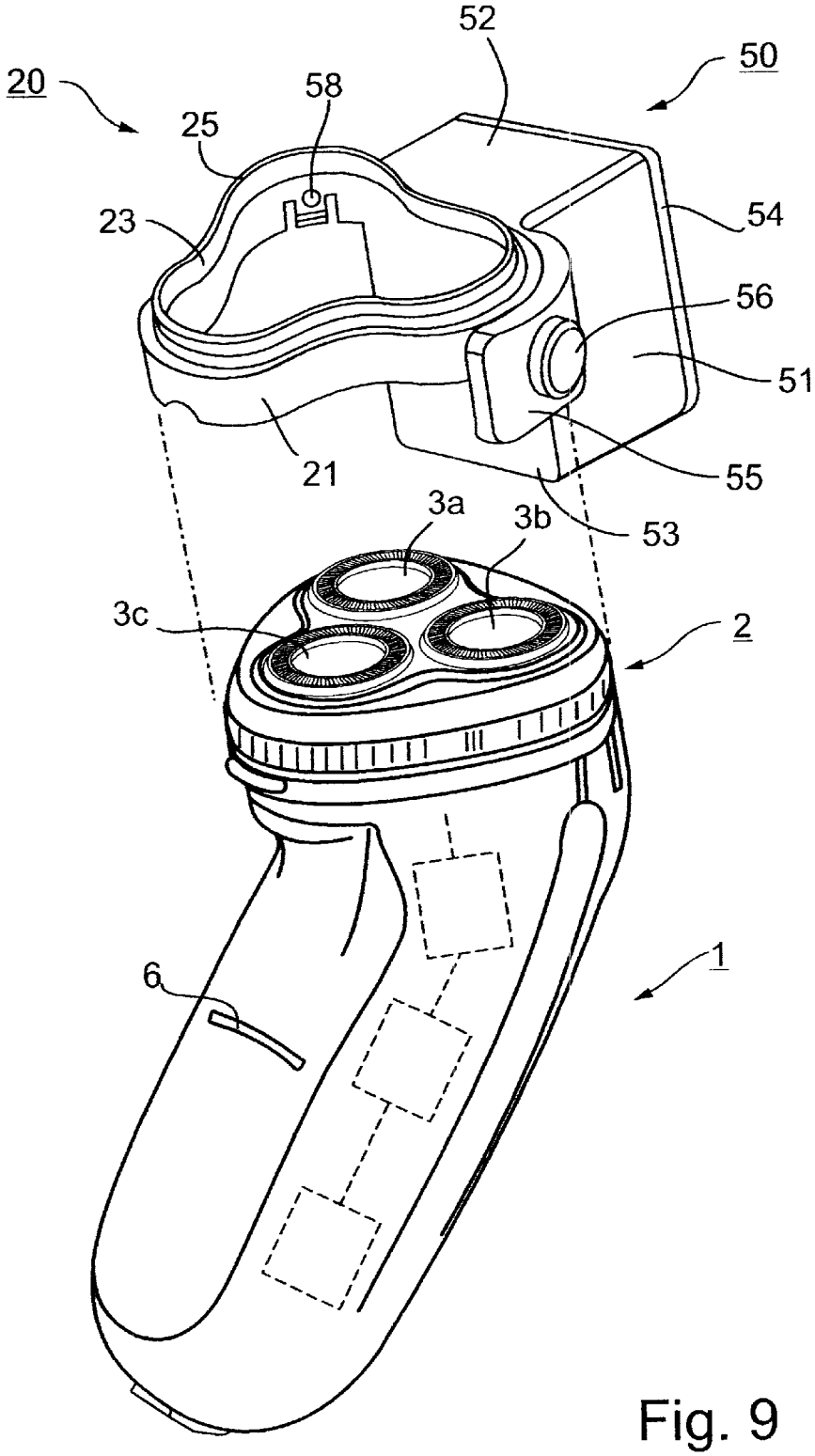
FIG. 9 is an exploded perspective view illustrating another form of electrical shaver attachment constructed in accordance with the present invention to include both a scraper cap and a dispenser of a shaving lotion to be dispensed by the user during shaving.
Figure 10:
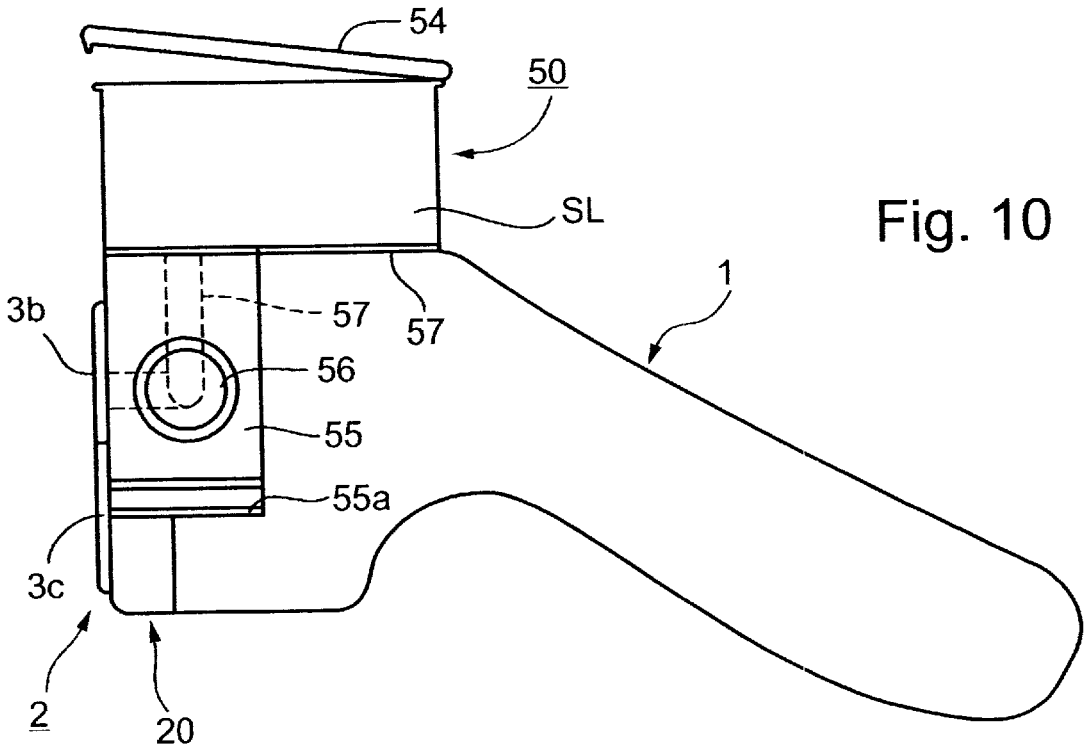
FIG. 10 is a side elevational view of the electrical shaver and the attachment of FIG. 9 attached.

FIG. 8 illustrates another variation in the construction of the cap 40, wherein the scraper edge, shown at 45 is manually extendible to an operative position, or retractable to an inoperative position, by a push-button 46.

FIGS. 9–12 illustrate an attachment, which includes both a scraper cap and a dispenser of shaving lotion, quickly attachable to the electric shaver whenever it is desired to use it for a wet shave with a shaving lotion. The electrical shaver and the scraper cap illustrated in FIGS. 9–12 may be of the same construction as illustrated in FIGS. 1–3, and therefore their parts are identified by the same reference numerals. The dispenser for the shaving lotion is generally designated 50 in FIGS. 9–11 and detachably secures, or is integrally joined with, the scraper cap 20 so that both are attachable and detachable together with respect to the electrical shaver.

Dispenser 50 is of generally rectangular configuration for holding a supply of a shaving lotion SL; it includes opposed side walls 51, opposed end walls 52, and a bottom wall 53, and is closeable by a pivotal lid 54. Dispenser 50 carries the scraper cap 20 so that, when the scraper cap encloses the cutter head assembly 2 as described above, the bottom wall 53 of the dispenser seats against the relatively flat upper portion of the shaver housing 1 adjacent to and overlying the cutter head assembly 2.

Dispenser 50 and cap 20 are attachable and detachable with respect to the shaver housing 1 and cutter head assembly 2 by means of a pair of elastic wings 55 integrally formed on the dispenser at its opposite sides. Elastic wings 55 engage the opposite sides of the cutter head and housing, and are releasably retained thereby on the housing. Each of the elastic wings has an out-turned tip 55*a* (FIG. 11) engageable by the opposite sides of the cutter head assembly 2 and shaver housing 1. The attachment, including scraper cap 20 and dispenser 50 for the shaving lotion, may thus be quickly attached to the shaver housing 1 by applying the attachment from the side, to cam the wings 55 apart, and then moved longitudinally of the housing sufficiently to seat the scraping cap 20 on the outer face of the cutter head assembly 2 so that the scraping cap occupies the position described above.

Figure 11:
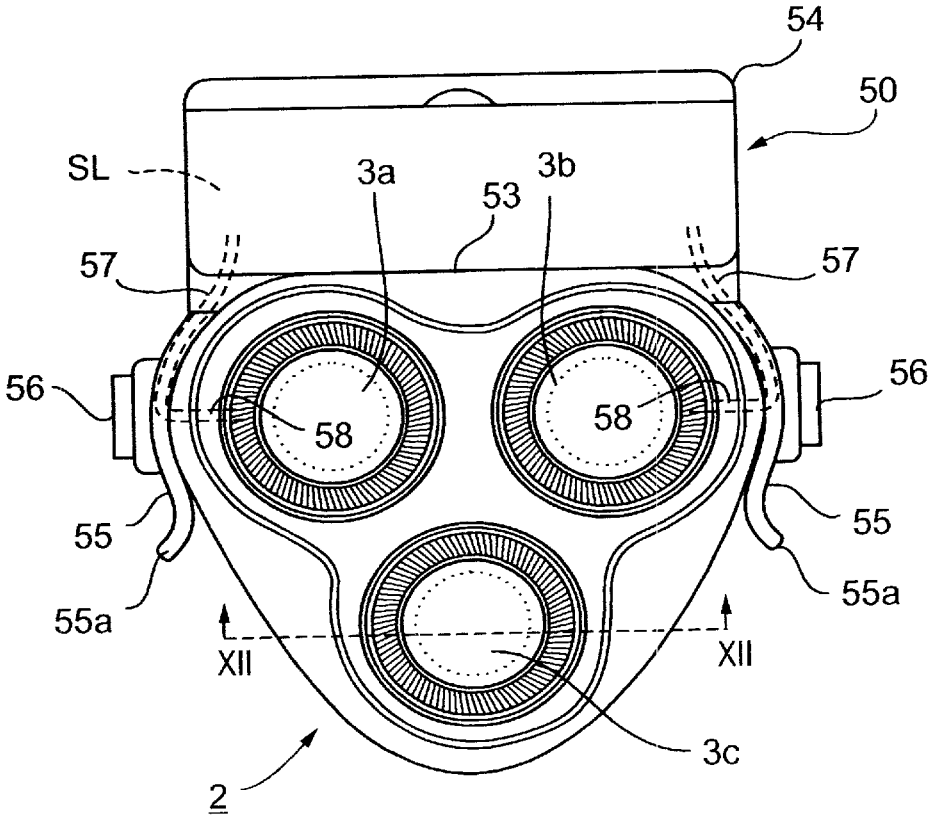
FIG. 11 is a front view of the electrical shaver and the dispenser of FIG. 9 attached.
Figure 12:
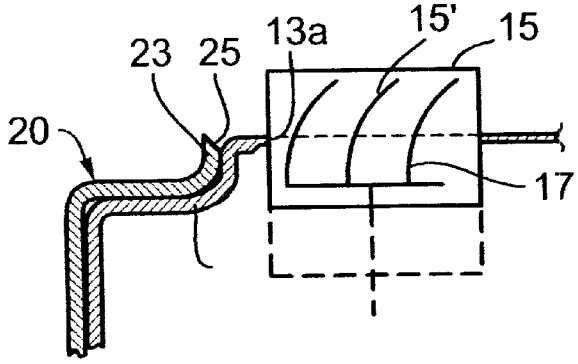
FIG. 12 is a sectional view along line XII—XII of FIG. 11.

The two side wings 55 carry two manually-depressable buttons 56 (FIG. 11) serving as manually-operated pumps for dispensing lotion SL from the interior of the dispenser 50, via passageways 57 and dispensing openings 58, to the cutter heads. FIG. 11 illustrates the dispensing openings 58 at the opposite sides of the cutter head assembly 2, but they could be at any desired location. With each depression of a button 56, a small quantity of lotion is dispensed via its respective dispensing opening 58 adjacent to the respective cutter head.

The manually-operated pumps may be of any conventional construction to include a one-way valve permitting flow from passageway 57 into a pumping chamber, and a one-way valve permitting flow from the dispensing chamber to the dispensing opening 58. The two buttons are spring-urged to their outer positions. Thus, depression of a button 56 contracts the pumping chamber to force the lotion therein out through the respective dispensing opening, whereas release of the button expands the pumping chamber to draw into it another small quantity of the lotion from the dispenser 50.

Preferably, the location of the inlet passageway 57 for each of the depressable buttons 56 is at a recessed portion in the bottom wall 53 of the dispenser 50 so as to permit dispensing substantially the complete contents of the holder.

The manner of using the attachment of FIGS. 9–12 will be apparent from the above description. Thus, if the shaver is to be used for a conventional dry shave, the attachment may be detached from the shaver housing, and the shaver used in the conventional manner. However, if the shaver is to be used for a wet shave using shaving lotion within dispenser 50, the attachment is first applied to the shaver via its side wings 55 to releasably engage the shaver housing 1 and the cutter head assembly 2 in the manner described above; and during a shaving operation, one or both buttons 56 are depressed to dispense a small quantity of the shaving lotion as and when desired.

Figure 13:
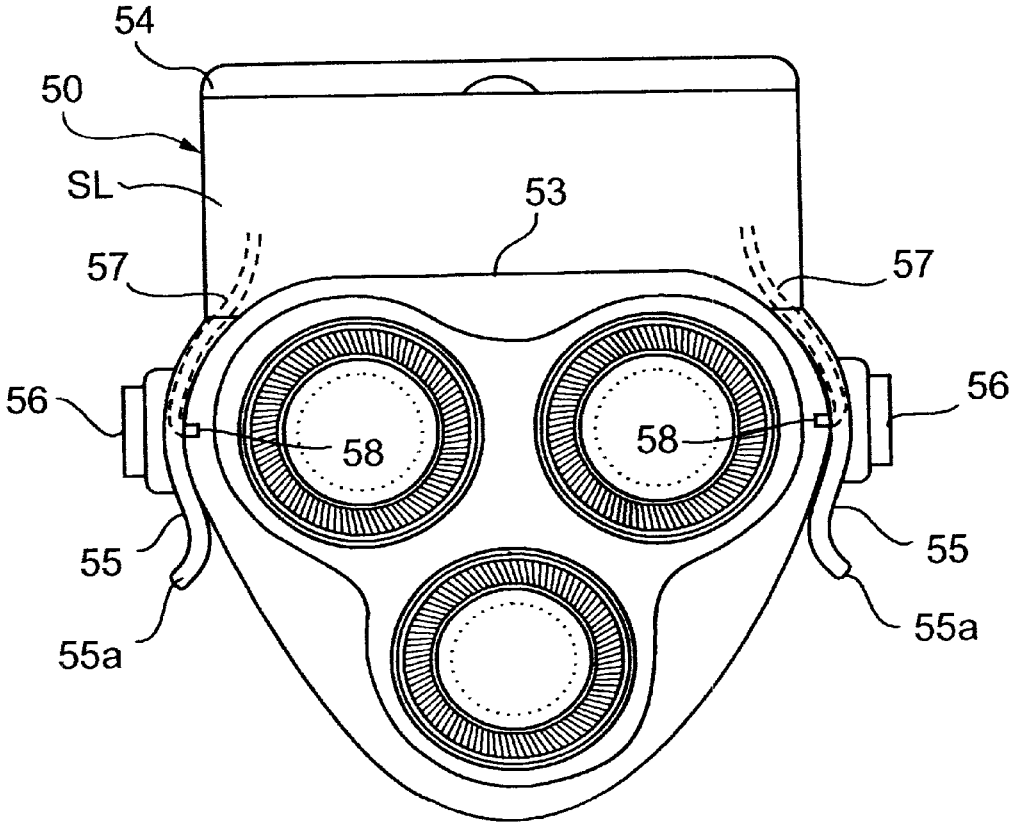
FIG. 13 is a view similar to that of FIG. 11 wherein the attachment does not include the scraper cap but merely the dispenser for the shaving lotion.

FIG. 13 illustrates an arrangement similar to that of FIGS. 9–12, except the scraper cap 20 is omitted, so that the attachment includes only the holder 50 for the shaving lotion. In this case, the dispensing openings 58 would be through the wings 55 to dispense the lotion at the desired locations with respect to the cutter heads.

Figure 14:
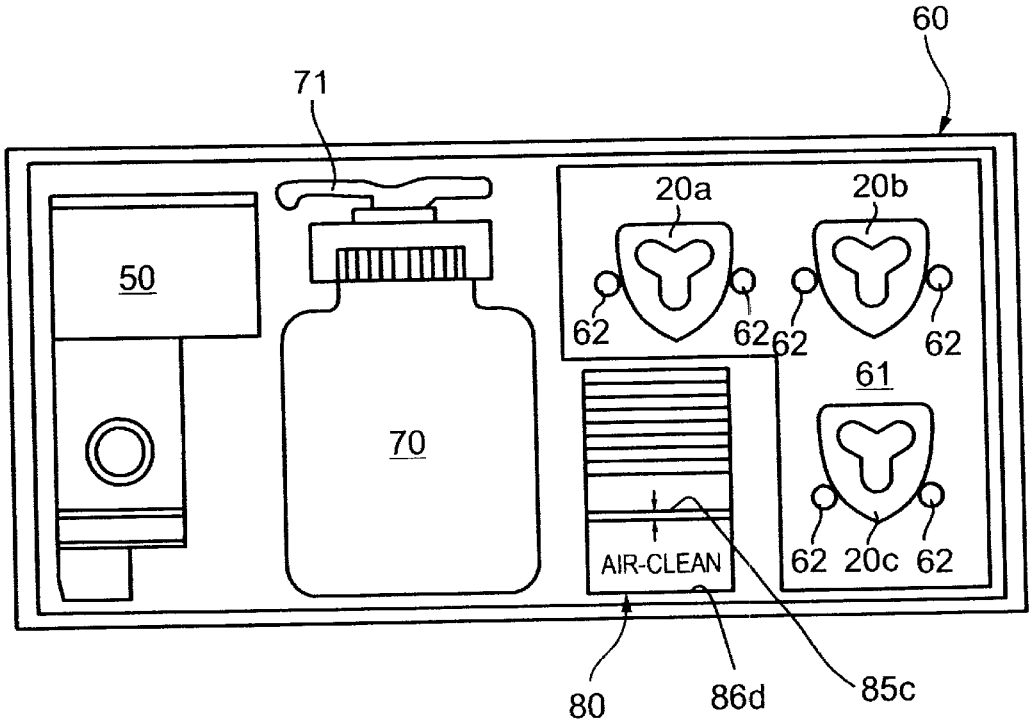
FIG. 14 illustrates one form of kit constructed in accordance with the invention, to include a plurality of scraper caps, a lotion dispenser, a supply of lotion, and also an auxiliary cleaning device.
Figure 15:
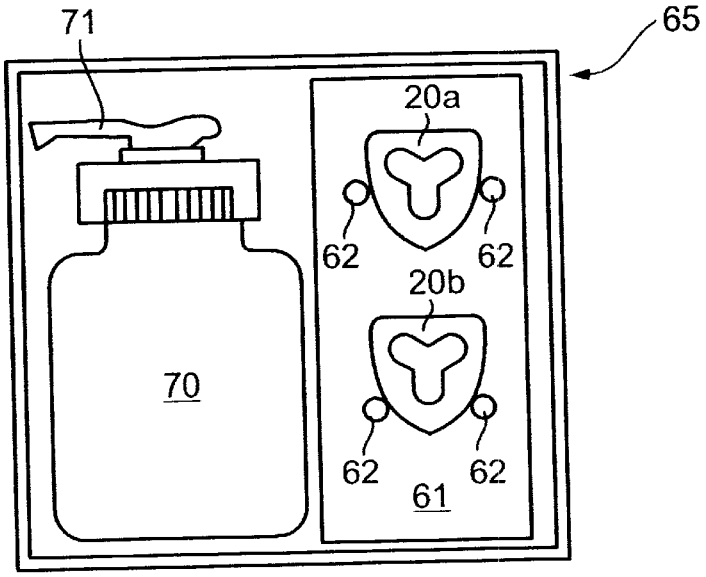
FIGS. 15, 16 and 17 illustrate simpler kits wherein some of the foregoing articles have been omitted.
Figure 16:
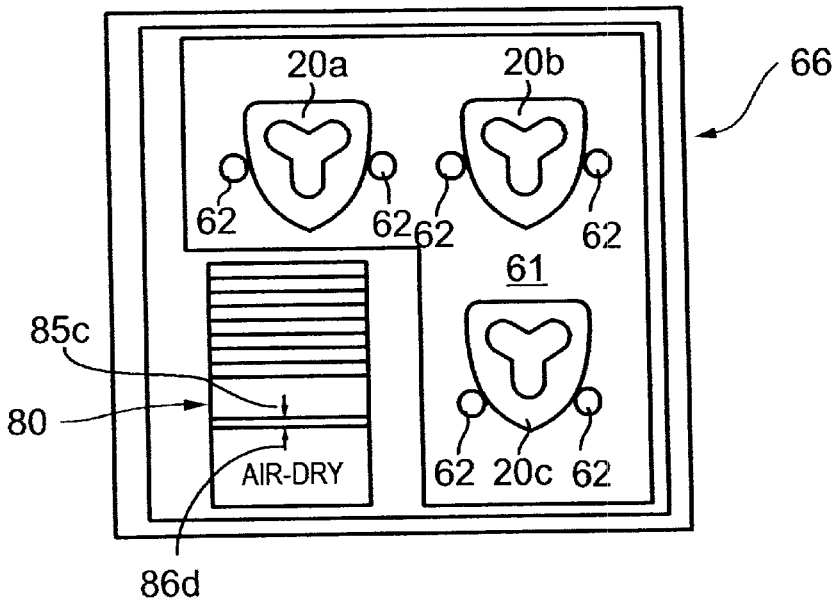

FIGS. 14–16 illustrate several kits which may be provided to include the scraper caps (e.g., 20, FIG. 1) with various types of accessories particularly useful for wet shaving (but also for dry shaving) with an electrical shaver.

Thus, FIG. 14 illustrates a kit, generally designated 60, including a receptacle and a plurality of scraper caps 20*a*–20*c* carried on a mounting section 61 of the receptacle and removably mounted thereto by clips 62. Preferably, the scraper caps 20*a*–20*c* have scraping edges (e.g., 25, FIG. 4 or 33, FIG. 5) of different heights to produce different degrees of scraping action according to the respective height of the scraping edge. For. example, one scraping cap may have a minimum scraping edge, or only a partial scraping edge as described above with respect to FIGS. 7 and 8, for use in dry shaving; another cap may have a medium scraping edge for use with a shaving lotion; whereas the third cap may have a relatively high scraping edge for use with soap and water which softens the hair as well as lubricates the skin. The scraping caps may be color-coded according to the degree of scraping action produced thereby; e.g., "green" for a minimum scraping edge, "yellow" for a medium scraping edge, and "red" for a high scraping edge.

Kit 60 illustrated in FIG. 14 further includes a lotion dispenser 50 as described above with respect to FIGS. 9–13 for releasably receiving a scraper cap. The kit also includes a container 70 containing a supply of lotion and provided with a conventional dispensing nozzle 71 which is manually depressible in order to dispense the lotion. The lotion in container 70 need not be a special shaving formulation, but could be, for example, any one of the skin moisturizers which are presently commercially available at relatively low cost: such skin moisturizers have been found to be particularly advantageous for wet shaving with the electrical shaver since they moisturize the skin, rather than dry it as does conventional soap.

Kit 60 illustrated in FIG. 14 further includes an auxiliary device, generally designated 80, described below with respect to FIGS. 18–21, particularly useful for air-drying the shaver head after wet shaving, or for air-cleaning the shaver head after dry shaving, as will be described more particularly below.

Figure 17:
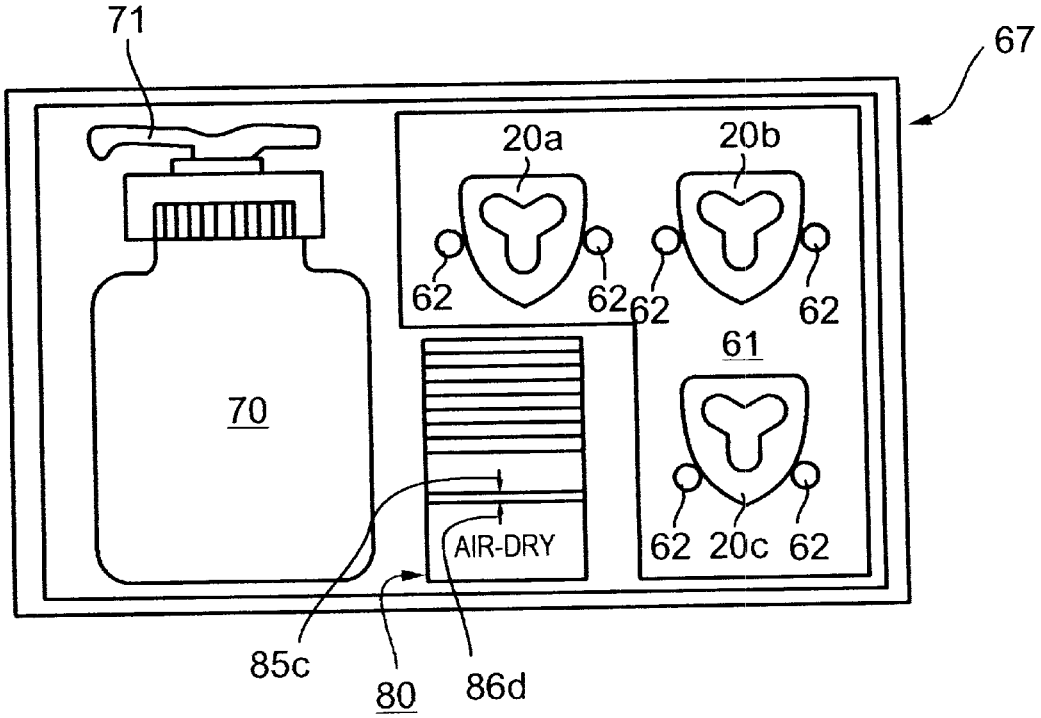
Figure 18:
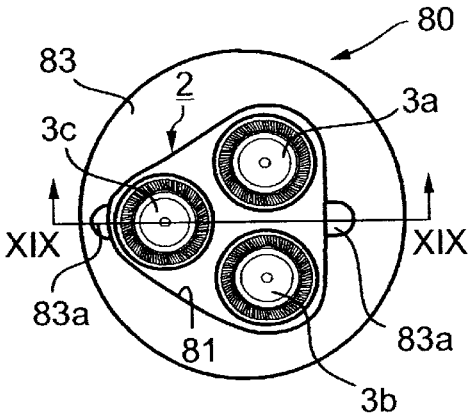
FIG. 18 is a top plan view of an auxiliary cleaning device included in the kits of FIGS. 14, 16 and 17.

FIGS. 15–17 illustrate kits in which some of the foregoing accessories have been omitted in order to reduce cost and size. Thus, the kit 65 illustrated in FIG. 15 includes only the scraper caps 20*a*–20*c* and the lotion container 70; the kit 66 illustrated in FIG. 16 includes only the scraper caps 20*a*–20*c* and the auxiliary drying/cleaning device 80; and the kit 67 illustrated in FIG. 17 includes only the scraper caps 20*a*–20*c*, the lotion container 70, and the auxiliary drying/cleaning device 80.

The auxiliary drying/cleaning device 80, as more particularly illustrated in FIGS. 18–21, includes a socket 81 for receiving a cutter head 2 after it has been detached from the housing of the electrical shaver. The auxiliary device 80 further includes a manually expansible and contractible chamber, generally designated 82, for impelling air through the cutter head 2 received in socket 81, either for air-drying the cutter head after used in wet shaving, or for air-cleaning the cutter head after used for dry shaving.

In the described preferred embodiment, chamber 82 is a bellows of cylindrical configuration. It includes an upper wall 83 formed with socket 81 of the same generally-triangular configuration as the shaver head 2 to be received within the socket. The upper wall 83 is preferably further formed with finger recesses 83*a* on the opposite sides of the socket 81 to facilitate manually applying and removing the shaver head 2.

Bellows 82 includes, besides the upper wall 83, also a cylindrical side wall 84, bottom wall 85, and base 86. The side wall 84 is formed with a plurality of transversely-extending fold lines 85 alternating in direction so as to define an expansible/contractible chamber 82'. A coil spring 87 interposed between the top wall 83 and bottom wall 85 urges the bellows 82 to its normal expanded condition as illustrated in FIG. 19, but permits it to be manually contracted, as shown in FIG. 20.

The top wall 83 is formed with an opening 83*b* producing air communication between the shaver head 2 received in socket 81, and the interior of the bellows 82. The bottom wall 85 is formed with a similar opening 85*a* for providing communication between the opposite end of the bellows and a discharge passageway 85*b* for discharging air from the bellows via a discharge passageway 86*a* formed in the base 86.

Discharge passageway 85*b* in bottom wall 85 includes a one-way valve 88 effective to permit air flow from the interior of the bellows 82 to the discharge passageway 86*a,* but to block in flow from these passageways into the bellows. Discharge passageway 86*a* in the base 86 is provided with a filter 89 received in a recess 86*b* for removing hair from the discharged air when the auxiliary device is used for air-cleaning a shaver head after a dry shave.

Figure 20:
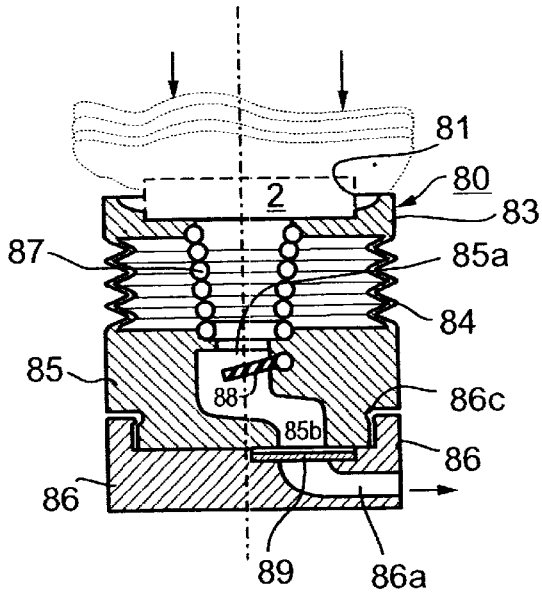
FIG. 20 is a corresponding sectional view but illustrating the auxiliary cleaning device in its contracted condition.
Figure 19:
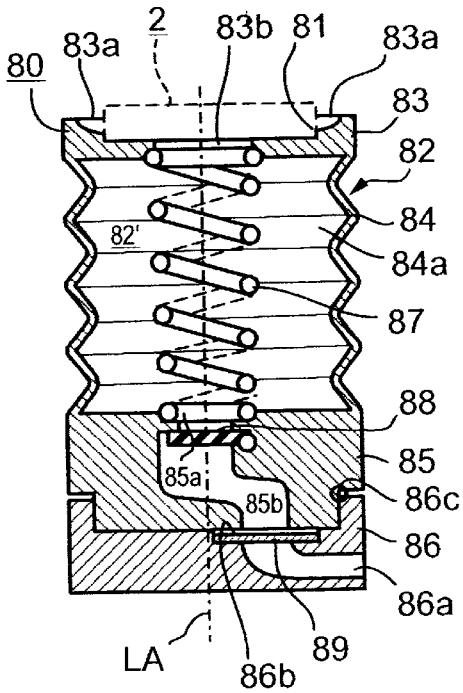
FIG. 19 is a sectional view along line XIX—XIX of FIG. 18.
Figure 21:
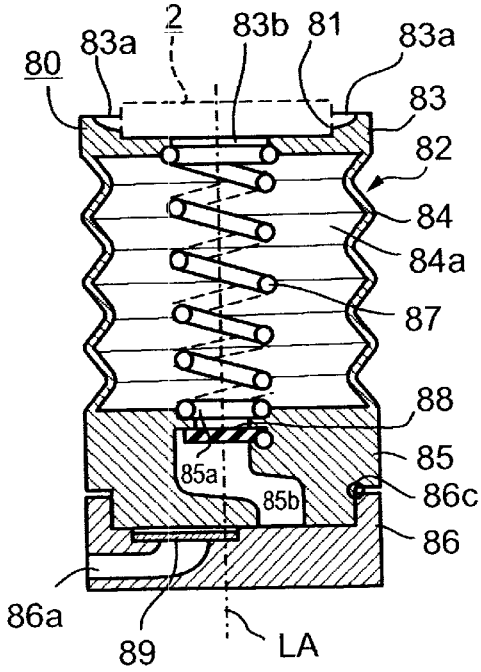
FIG. 21 is a view similar to that of FIG. 19 but showing the auxiliary cleaning device in the condition for drying a cutter head after used for wet shaving and water rinsed.

As shown in FIGS. 19 and 20, the outlet end of discharge passageway 85*b* and the inlet end of discharge passageway 86*a* are eccentric with respect to the longitudinal axis LA of the bellows 82; also, the outlet end of discharge passageway 86*a* is through the side wall of the base 86. Base 86 is rotatably mounted by a peripheral flange 86*c* to the bottom wall 85 so that it may be manually rotated to the position illustrated in FIGS. 19 and 20, connecting the outlet end of discharge passageway 85*b* to the atmosphere via discharge passageway 86*a,* or to the position illustrated in FIG. 21 blocking the outlet end of discharge passageway 85*b.* Base 86 is also removable from the bottom wall 85, by snapping its flange 86*c* out of an annular recess in bottom wall 85, in order to provide access to the filter 89 for cleaning or replacement purposes.

Base 86 is in the position illustrated in FIGS. 19 and 20 when the auxiliary device is to be used for air-cleaning a shaver head 2 after used for dry shaving. Thus, after a dry shaving operation, the shaver head 2 may be detached from the shaver and placed within socket 81. The user then places the user's hand over the upper surface of the shaver and presses downwardly, as shown in FIG. 20, to compress the bellows 82, and then removes the hand from the shaver head to permit the spring 87 to restore the bellows to its expanded condition. These movements may be repeated several times in quick succession. Each downward movement discharges the air from the bellows through discharge passageways 85*b,* 86*a,* whereas each upward movement (by the spring 87) draws air from the outside through the shaver head 2 (uncovered by the user's hand) into the bellows. Thus, the air drawn through the shaver head into the bellows air-cleans the shaver head. The discharge of the air via the discharge passageways 85*b,* 86*a* via the filter 89 causes the filter to remove the hairs before being discharged to the atmosphere. Whenever the filter 89 requires cleaning or replacement, this is easily done snapping flange 86*c* of the base 86 from the bottom wall 85 to expose the filter.

If the shaver head 2 is used for wet shaving, it may be water-rinsed to remove the shaving lotion, soap, or other wet lubricating substance applied, and then inserted into socket 81 for air drying. When the auxiliary device is used for this purpose, base 86 would be rotated to the position illustrated in FIG. 21, blocking the outlet end of discharge passageway 85*b.* In addition, the user would contract the bellows 82, not by applying the hand over the upper end of the shaver head, as illustrated in FIG. 20, but by engaging the opposite sides of the upper wall 83 such that each spring expansion action will draw air from the atmosphere through the shaver head 2, and each manual contraction action will impel the air in the reverse direction from the bellows out to the atmosphere through the shaver head 2. Thus, several compressions and expansions of the bellows will impel the air in both directions through the shaver head to quickly dry it.

The outer surfaces of the bottom wall 85 and base 86 may be provided with markings 85*c,* 86*d* (FIGS. 14, 16, 17) to indicate the position of the base 86 with respect to the bottom wall 85. Thus, the markings in FIG. 14 indicate the base is in an "air-clean" position, namely with the discharge passageway 86*a* aligned with passageway 85*b* as shown in FIGS. 19 and 20 for air-cleaning the shaver head and collecting the hairs on the filter 89; whereas FIGS. 16 and 17 illustrate the base 86 in the "air-dry" position, namely that shown in FIG. 21 wherein discharge passageway 86*a* blocks passageway 85*b,* for air-drying the shaver head after it has been used for wet shaving and water rinsed.

While the invention has been described with respect to several preferred embodiments, it will be appreciated that these are set forth merely for purposes of example, and that many variations and other applications of the invention may be made. For example, the invention could be applied to other types of electric shavers, such as the vibratory-type. In addition, the scraping edge need not be a common scraping edge for all the shear members, but rather could be a separate scraping edge for each of the shear members. Further, the scraping cap could be provided with a rounded edge for distributing the lotion and taughtening the skin, rather than a sharp edge for scraping the skin and erecting the hairs. In addition, other retainer arrangements could be used for retaining the scraper cap on the shaver head, e.g., retainer tabs such as provided in the protective cap of the "Cool Skin" Philishave electric shaver. Also, the manually expansible/contractible chamber in the auxiliary cleaning/drying accessory 80 could be a piston/cylinder arrangement, rather than a bellows. In addition this chamber, as well as the lotion container 70, could be of square or other configuration in cross-section.

Many other variations and applications of the invention will be apparent.

What is claimed is:

1. An attachment for an electrical shaver including a housing having an electrical motor, and a cutter head carried at one end of the housing and driven by the electrical motor; said attachment including a cap having a sharp scraping edge located to engage a user's skin forwardly of the cutter head, when the cap is attached to the shaver, to erect hairs and to taughten the skin before engaged by the cutter head;

wherein the cutter head includes: a plurality of shear members each located within an opening in said end wall, and a plurality of rotary cutter members each located within a shear member; said cap being formed with an enlarged opening defined by a border configured to circumscribe all said shear members; said border including a said scraping edge to be located slightly forwardly of at least one of said shear members when the cap is attached to the shaver for wet shaving; and wherein the housing end wall of the shaver is formed with a peripheral step circumscribing a planar section formed with the openings in which the shear members are located; said border in the cap being of the same configuration as said step, and being seatable against said step to locate said scraping edge with respect to its respective shear member.

2. The attachable according to claim 1, wherein the shear members and their respective rotary cutter members of the shaver are spring-urged from a retracted position substantially flush with said planar section of the housing end wall to an outer position outwardly thereof; said scraping edge of the cap projecting outwardly of said planar section of the housing end wall when the cap is attached to said housing so as to be pressed into the user's skin when the shear members are pressed against the user's skin and move from their outer position to their retracted positions during shaving.

3. The attachment according to claim 1, wherein said cap is integrally formed with said scraping edge.

4. The attachment according to claim 1, wherein said scraping edge is movable to an extended operative position or to a retracted unoperative position.

5. An attachment for an electrical shaver including a housing having an electrical motor, and a cutter head carried at one end of the housing and driven by the electrical motor; said attachment including a cap having a sharp scraping edge located to engage a user's skin forwardly of the cutter head, when the cap is attached to the shaver, to erect hairs and to taughten the skin before engaged by the cutter head; wherein said attachment further includes a holder for holding a supply of a shaving lotion, and a manually-operated pump carried by said holder; said holder being formed with a dispensing opening for dispensing a quantity of shaving lotion from said holder upon the manual operation of said pump; said holder and cap being secured together so as to be attachable and detachable together with respect to said housing.

6. The attachment according to claim 5, wherein said holder is attachable and detachable with said cap from said housing by a pair of elastic wings integrally formed on said holder at opposite sides thereof to engage the opposite sides of said cutter head, and to be releasably retained thereby on the housing.

7. The attachment according to claim 5, wherein each of said wings is provided with a manually-operated pump and a dispensing opening for dispensing a quantity of shaving lotion from said holder upon the manual operation of the respective pump.

* * * * *